United States Patent [19]

Matsuki et al.

[11] Patent Number: 5,074,457

[45] Date of Patent: Dec. 24, 1991

[54] METHOD AND APPARATUS FOR SPLICING METAL WEBS

[75] Inventors: Masaya Matsuki; Hirokazu Sawada; Tsutomu Kakei, all of Shizuoka, Japan

[73] Assignee: Fuji Photo Film Co., Ltd., Kanagawa, Japan

[21] Appl. No.: 649,257

[22] Filed: Jan. 31, 1991

Related U.S. Application Data

[63] Continuation of Ser. No. 391,826, Aug. 10, 1989, abandoned.

[30] Foreign Application Priority Data

| | | | |
|---|---|---|---|
| Aug. 11, 1988 | [JP] | Japan | 63-201336 |
| Jun. 5, 1989 | [JP] | Japan | 1-142721 |
| Jun. 5, 1989 | [JP] | Japan | 1-142722 |

[51] Int. Cl.[5] ..... B23K 31/02; B23K 37/08

[52] U.S. Cl. ..... 228/158; 228/5.7

[58] Field of Search ..... 228/158, 235, 117, 5.7, 228/19

[56] References Cited

U.S. PATENT DOCUMENTS

| | | | |
|---|---|---|---|
| 3,119,289 | 1/1964 | Bach | 228/19 |
| 3,421,676 | 1/1969 | Jenkins | 228/19 |
| 3,737,979 | 6/1973 | Rakich et al. | 228/158 |
| 3,864,813 | 2/1975 | Morjan | 228/158 |
| 4,558,695 | 12/1985 | Kumazawa et al. | 228/158 |

OTHER PUBLICATIONS

Metals Handbook Ninth Edition, vol. 14, pp. 630, 348, copyright Apr. 1988.

*Primary Examiner*—Samuel M. Heinrich

*Attorney, Agent, or Firm*—Sughrue, Mion, Zinn Macpeak & Seas

[57] ABSTRACT

Method and apparatus for splicing together metal webs with the ends thereof being butted against each other or slightly lapped on each other. In the metal web splicing apparatus, there is provided a reduction roller which comprises a hold portion having a first radius and a projected portion having a second radius slightly greater than the first radius. With use of the reduction roller, while both sides of the weld spliced portion of the metal webs are being held and fixed by the hold portion of the roller, the weld spliced portion is rolled by the projected portion of the roller, thereby preventing escape of the rolled portion.

12 Claims, 10 Drawing Sheets

METHOD AND APPARATUS FOR SPLICING METAL WEBS

This is a continuation of application No. 07/391,826, filed Aug. 10, 1989 now abandoned.

BACKGROUND OF THE INVENTION

1. Field of the Invention

The present invention relates to method and apparatus for splicing together metal webs and, in particular, to such method and apparatus in which the metal webs are in part rolled.

2. Description of the Related Art

As a conventional metal webs splicing technique, there is known a technique in which a reduction roller is used to roll welded beads (Japanese Utility Model Application Laid-open (Jikkai) No. 62-179116).

Referring now to FIG. 13, there is shown a conventional splicing apparatus in which a roller 50 with projected portion 54 is used to reduce the thickness of a metal web 52 in part. That is, the roller 50 has a projected portion 54 existing successively in the outer periphery thereof and the metal web is held or fixed by a fixing jig 56 to a table 58 and after that it is rolled by the projected portion 54.

In FIG. 14, there is shown a conventional splicing method in which the projected portion 54 of the projection roller 50 is used to reduce a level difference in a spliced portion 60 between the two metal webs 52, 52 to improve the shape of the spliced portion so as to prevent centralization of stresses. The spliced portion 60 is situated on a back bar 62, is held or fixed by the fixing jigs shown in FIG. 14 or by a suction table 64, and is rolled by the projected portion 54 of the above-mentioned roller 50.

In FIG. 15, there is shown a method or rolling the end portion (the portion to be spliced) of the metal web 52 by use of the projected portion 54 of the roller 50 and, according to this method, the strip-shaped metal plate 52 is held or fixed by a stop jig 66 at the portion thereof adjacent to the passage of the roller 50 so as to prevent the metal web 52 from escaping out of position.

However, the above-mentioned metal webs splicing apparatus has been found disadvantageous in the following respects.

In other words, when a metal web to be rolled is thin and has a low rigidity, there are easily produced inconveniences such as constrictions and/or wrinkles. The production of the constrictions and wrinkles has a greatly ill effect on the flatness of the metal web as well as the precision of the shape thereof. Also, due to the fact that such constrictions and wrinkles are caused by the distortion of the portion to be rolled, if the pressure of rolling is increased, then the constrictions and wrinkles produced are further increased. This limits the magnitude of the rolling pressure, thereby lowering a working efficiency.

Also, in a conventional splicing method in which metal webs are butt-spliced together or lap-spliced together and the resultant spliced portion is rolled, if the metal webs are thin and have a low rigidity, constrictions and/or wrinkles are easy to occur in the spliced portion. When the spliced metal webs are carried or transferred over a large number of pass rollers successively in the following steps, stresses can be centralized on such constrictions and/or wrinkles existing on the spliced portion of the metal webs with the result that the spliced metal webs can be easily broken at such constrictions and/or wrinkles thereof.

In addition to the above, when such spliced portion is passed as a part of the metal web through a surface treatment step which is one of the following steps, there can be incurred various kinds of disadvantages.

For example, in a coating step of photosensitive layer in manufacturing a (lithographic) (planographic) printing plate, when the constrictions and/or wrinkles in the spliced portions are passed, through a coating device, the coating device must be shunted or moved aside in order to prevent against damage. Also, when the coating device is not shunted, the constrictions and/or wrinkles may swallow air bubbles therein, which has an ill effect on the state of the coated layer, resulting in a poor quality. Such constrictions and/or wrinkles caused by rolling the spliced portion in particular, occur remarkably when two or more thin metal webs each having a thickness of 0.1 mm to 0.2 mm are spliced together or when two or more metal webs having different thicknesses are spliced together.

Also, when the end portion (the portion to be spliced) of a metal web is to be previously rolled, if the width of the projected portion of the roller with projected portion is small with respect to a distance between the stop jig and the metal web end portion, then the metal web is very easy to escape out of place. Further, if the rolling pressure or downward pressure is decreased for prevention of escape of the metal web, then a working efficiency in rolling is disadvantageously lowered.

Moreover, in the conventional method and apparatus shown in FIGS. 13, 14 and 15, in a rolling process, when compared with the other portions of the metal web, in the spliced portion of the metal web, surface hardening occurs as well as the metal structure of the spliced portion is caused to change or deform. Such surface hardening and change or deformation of the metal structure give rise to various kinds of disadvantages when the spliced portion passes, as a part of the metal web, through a surface treatment step which is one of the following steps. For example, in a surface roughening step in a lithographic printing plate manufacturing process due to the fact that the spliced portion has been hardened by rolling, when the surface of the metal web is roughened mechanically by an abrasive or the like, the surface of the spliced portion may be hard to be roughened. Also, due to the fact that the metal structure of the spliced portion has been changed or deformed, when the metal web is surface roughened in an electrochemical manner, the spliced portion cannot be surface roughened sufficiently. Since the insufficiently surface roughened spliced portion provides a surface which is poor in wettability, when it passes through a coating step of such as a photosensitive layer or the like which is one of the following steps, the spliced portion may be in part short of the amount of application of coating solution and, the coating may be applied to such insufficient portion too much, which occurs just after the short application of the coating solution.

Also, if the above-mentioned excessive coating of the solution occurs, then the excessively coated surface of the spliced portion cannot be dried sufficiently and, therefore, when such coated surface of the spliced portions transferred over a pass roller or the like, the applied or coated solutions can be attached to the pass roller which has a greatly ill effect on the quality of the spliced metal webs.

In addition, since the projected portion of the rolling roller is transferred to the spliced portion, there is produced a level difference between the rolled portion and the unrolled portion. This level difference gives rise to various disadvantages in a surface treatment step which is one of the following steps. For example, in a coating step of a photosensitive layer in a planographic printing plate manufacturing process, when the level different section of the spliced portion is passed through, it swallows in air bubbles, which has an ill effect on the coated state of the metal web spliced portion, resulting in the deteriorated quality of the metal web. As the difference between the thickness of the metal web to be spliced is increased, the above-mentioned level difference in the spliced portion is increased.

SUMMARY OF THE INVENTION

The present invention aims at eliminating the drawbacks found in the above-mentioned prior art method and the conventional apparatus.

Accordingly, it is an object of the invention to provide method and apparatus for splicing together metal webs, in which, when rolling the spliced portion of metal webs each having a small thickness and a low rigidity which are butt spliced or lap spliced, no constrictions or wrinkles can be produced to thereby be able to strengthen the spliced portion and also, when previously rolling the portion of a metal web to be spliced, the metal web is prevented from escaping out of position to thereby be able to apply a sufficient rolling pressure to the portion to be spliced.

In order to achieve the above object, according to the invention, there is used a roller which comprises a hold portion having a first radius and a projected portion having a second radius greater than the first radius by 0.1~5.0 times the thickness of the metal web to be rolled. That is, while the metal web is held by the hold portion, the spliced portion or the portion to be spliced of the metal web is rolled by the projected portion of the roller.

According to the invention, a rolling operation is carried out by use of a roller including a projected portion which is formed to project slightly out of a hold portion of the roller, that is, with the metal web being held by the hold portion of the reduction roller, the spliced portion or the portion to be spliced of the metal web is rolled by the roller. Due to this, the spliced portion or the portion to be spliced of the shaped metal web to be rolled can be rolled with no constrictions, wrinkles or escape occurring, so that the spliced portion or the portion to be spliced can be strengthened, a working efficiency can be maintained reasonably, and no disadvantages can be provided in a surface treatment step.

Also, it is another object of the invention to provide method and apparatus for splicing together metal webs which are capable of preventing insufficient surface roughening and insufficient coating of the spliced portion of metal webs in steps of surface roughening and coating the metal webs.

In attaining this object, according to the invention, in a method of splicing together metal webs wherein the metal webs are butted against each other or lapped slightly on each other and are spliced together by welding, and the welded spliced portion is then rolled, the spliced portion is rolled by use of a rolling portion, the surface of which has been roughened.

According to the invention, a roughened surface portion is formed in the surface of a reduction roller. When rolling the welded spliced portion, the surface of the welded spliced portion can be roughened by transferring the roughened surface portion and, therefore, in a coating step, the wettability of the spliced portion surface can be kept well to thereby prevent against occurrence of poor coating.

Further, it is still another object of the invention to provide method and apparatus for splicing together metal webs which can be capable of preventing against occurrence of poor quality or faulty spliced metal due to varying coating states.

In order to accomplish this object, according to the invention, there is provided a metal web splicing apparatus in which metal webs are butted against each other or slightly lapped on each other and then spliced together by welding and in which a roller comprising a hold portion having a first radius and a projected portion having a second radius greater than the first radius is used to roll the welded spliced portion in such a manner that, while the metal web is being held by the hold portion of the roller, the welded spliced portion is rolled by the projected portion of the roller, characterized in that a level difference portion between the projected and hold portions is formed in a tapered or curved shape.

According to the invention, the level difference portion existing between the projected and hold portions of the roller is shaped, tapered or curved to thereby smooth the level difference in the metal web spliced portion to be rolled and, therefore, there is eliminated any influences due to swallow-in of air bubbles or the like to thereby prevent occurrence of poor quality spliced metal plates.

BRIEF DESCRIPTION OF THE DRAWINGS

The exact nature of this invention, as well as other objects and advantages thereof will be readily apparent from consideration of the following specification relating to the accompanying drawings, in which like reference characters designate the same or similar parts throughout the figures thereof and wherein.

DETAILED DESCRIPTION OF THE INVENTION

A detailed description will hereunder be given of the preferred embodiments of method and apparatus for splicing together metal webs according to the present invention with reference to the accompanying drawings.

Figure 1:
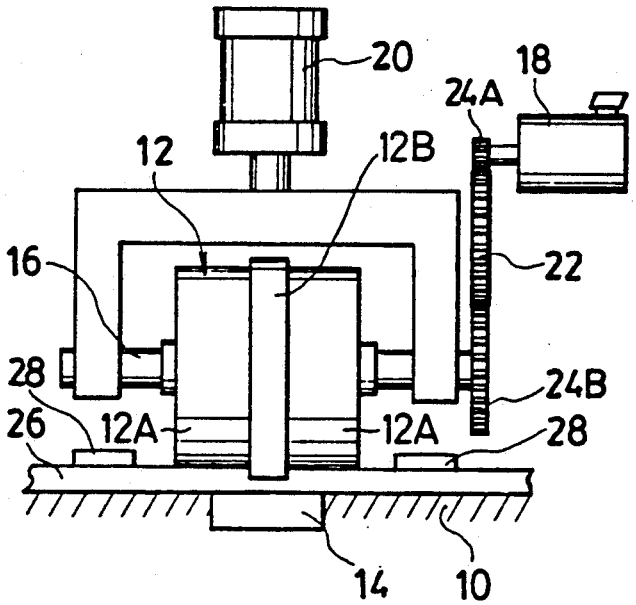
FIG. 1 is a side view of a splicing apparatus according to the invention.

Referring first to FIG. 1, there is shown an explanatory view of an embodiment of a splicing apparatus according to the invention. The splicing apparatus mainly consists of a splicing table 10, a reduction roller 12, a back bar 14, a shaft 16, a motor 18, a downward pressing cylinder 20 and the like.

The roller 12 comprises a hold portion 12A having a first radius and a projected portion 12B having a second radius. A difference between the first and second radius, that is, an amount of projection of the projected portion 12B may be 0.1~5.0 times, preferably, 0.5~2.0 times the thickness of a member to be rolled. The reduction roller 12 can be formed of one of a high speed steel such as $SKH_9$ or the like, a dies steel such as $SKDH_{11}$ or the like, cemented carbides, ceramics such as $Si_3N_4$, SiC, $Al_2O_3$, $ZrO_2$ or the like, and CBN. Also, if necessary, the surface of the reduction roller 12 may be coated with TiN, WC or the like in order to improve its wear resistance and to prevent the member to be rolled from being condensed and attached to the roller.

The splicing table 10 is set on a holder (which is not shown) of the splicing apparatus and the back bar 14 is fixed to the substantially central portion of the table 10. Also, the reduction roller 12 is arranged such that it can be moved on the splicing table 10 along the spliced portion and it is also rotatably journaled by the shaft 16. Further, the reduction roller 12 can be pushed toward the splicing table 10 by means of operation of the cylinder 20. In addition the roller 12 can be rotated and driven by the motor 18 through a gear 24A, a chain 22 and a gear 24B.

Next, description will be given below of the operation of the metal web splicing apparatus constructed in the above-mentioned manner.

At first, a metal web 26 to be spliced is held or fixed by a stop jig 28 to the splicing table 10 in such a manner that the central part of the portion thereof to be rolled is situated on the back bar 14. Next, the reduction roller 12 is pushed down by the cylinder 20 so that the web metal plate 26 is pressed and fixed by the hold portions 12A 12A. And, if the motor 18 is driven, then the rotational movements of the motor 18 are transmitted to the reduction roller 12 through the gear 24A, chain 22 and gear 24, whereby the metal web can be rolled while the central part of the above-mentioned rolling portion thereof is held between the projected portion 12B and the back bar 14. This rolling operation can reduce in part the thickness of the metal web 26.

Due to the fact that the central part of the rolling portion is rolled by the projected portion 12B while it is held by the hold portions 12A and 12A, the present splicing apparatus is able to restrict the distortion that would inevitably occur, when compared with a conventional splicing apparatus using a conventional roller with projected portion. This is, when the metal web 26 is thin and has a low rigidity. the constrictions and/or wrinkles that would occur in the central part of the rolling portion can be reduced. For this reason, there is eliminated the need to limit the magnitude of the push-down forces and thus a working efficiency will never be lowered.

Figure 2:
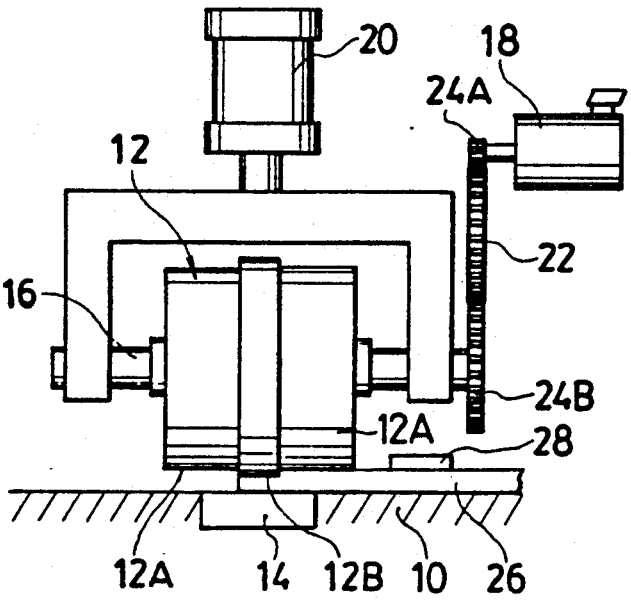
FIGS. 2 and 3 are respectively side views of a splicing apparatus, illustrating method of splicing together metal webs according to the invention.

Next, with the reference to FIG. 2, description will be given below of an embodiment in which the rolling portion (more exactly, the portion to be rolled) of the metal web is rolled by use of the splicing apparatus shown in FIG. 1.

At first, the metal web 26 is held or fixed onto the splicing table 10 by the stop jig 28. Next, the roller 12 is pushed down by the cylinder 20 and the central part of the rolling portion is held between and fixed by the projected portion of the roller 12 and the back bar 14. And, while the portion 26A of the metal web 26 adjacent to the end portion of the rolling portion thereof is being held to the splicing table 10 and back bar 14 by the hold portions 12A of the reduction roller 12, the projected portion 12B rolls the end portion of the butted or lapped portion to be spliced of the metal web.

By using such rolling method, even if the width of the projected portion 12B of the reduction roller 12 is smaller with respect to a distance between the stop jig 28 and the above-mentioned end portion, since the metal web 26 is held by the hold portions 12A of the reduction roller 12, there is eliminated the possibility that the metal web 26 may escape from the projected portion 12B of the reduction roller 12. This eliminates the need to reduce the push-down force and thus the rolling operation can be performed efficiently. That is, the splicing of the metal web can be realized very efficiently.

Figure 3:
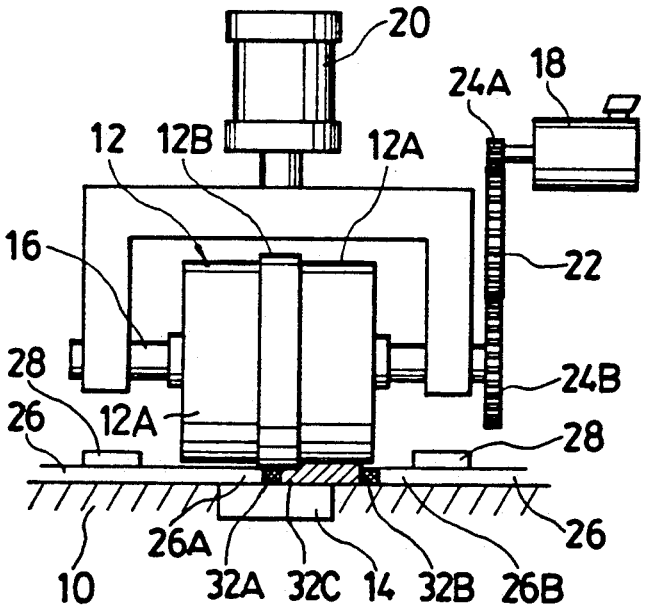

Referring now to FIG. 3, there is shown a method of rolling the spliced portion of metal web having different thicknesses, illustrating a case in which, out of two recrystallized portions 32A, 32B occurring in the weldedly spliced portion, the recrystallized portion 32A, and a metal web 26A and a fused portion 32C respectively adjoining the recrystallized portion 32A are rolled by use of the splicing apparatus already discussed in connection with FIG. 1. At first, the metal web 26 that is spliced by welding is fixed onto the splicing table 10 by the stop jig 28. Next, the reduction roller 12 is pushed down by the cylinder 20 and the central part of the rolling portion is held between and fixed by the back bar 14 and the projected portion of the reduction roller 12. And, the portion of the metal web 26 adjacent to the central part of the rolling portion is held against the table 10 and back bar 14 by the hold portions 12A of the reduction roller and the recrystallized portion 32A, fused portion 32C and metal web 26A can be rolled simultaneously by the projected portion 12B. That is, the recrystallized portion 32A as well as the fused portion 32C and metal web 26A respectively adjoining the recrystallized portion 32A can be rolled in such a manner that they have substantially the same thickness (more exactly, the difference among their respective thicknesses is within 30%).

Also, other recrystallized portion 32B, fused portion 32C and metal web 26B can be rolled similarly to the above-mentioned ones.

According to the method and apparatus for splicing together metal webs according to the present invention and constructed in the above-mentioned manner, while the neighboring portion of the central part of the rolling portion is being held, a predetermined range of the spliced portion can be rolled and, therefore, even if a narrow range is selectively rolled with a high pressure, the constrictions and/or wrinkles are not likely to occur. For this reason, only the thick part of the butt or lap spliced portion can be rolled to thereby make all of uniform thickness, so that the centralization of stresses on the spliced portion can be reduced to thereby improve the flatness of the neighboring portion of the spliced portion. Also, in the butt or lap welded spliced portion, by reducing a difference between the thicknesses of the neighboring portions of the recrystallized part having a low repetitive bending strength, the centralization of stresses on the recrystallized portion can be reduced.

Also, in order to surely perform an operation of reducing the thickness of the end portion of the metal web, for example, by reducing the difference between the thickness of metal webs greatly differing in thickness from each other before they are spliced together, the splicing strength can be improved.

Next, description will be given below of results obtained when the spliced portion of the metal webs spliced according to the present invention is compared with that spliced according to the conventional splicing method.

(TEST EXAMPLES)

In a first two aluminum webs, one of them having a thickness of 0.30 mm and a width of 200 mm and the other having a thickness of 0.15 mm and a width of 200 mm, are lapped by 1 mm on each other and the lapped portion is TIG arc welded at the speed of 1m/min, so that the two aluminum webs are spliced together. After spliced together in this manner, the spliced portion is rolled by a reduction roller having a width of 4 mm and an amount of projection of 0.3 mm in such a manner that a difference between the thicknesses of the neighboring portions of the recrystallized portion occurring on the side of the aluminum webs having a width of 0.15 mm can be reduced. This is called a sample No. 1. Also, the above-mentioned spliced portion of the two aluminum webs is rolled similarly by use of a roller with projected portion having a width 4 mm and amount of projection of 6 mm. This is called a sample No. 2. Further, after two aluminum webs are spliced by welding, the thickest part of the spliced portion is rolled by a flat roller having no projected portion. This is called a sample No. 3. In a still further case the end portion to be spliced of the aluminum plate having a thickness of 0.30 mm is rolled down to a thickness of 0.20 mm by use of a reduction roller having a width of 4 m and an amount of projection of 0.30 mm before it is spliced by welding, and, after then, the spliced portion is further rolled similarly as in the sample No. 3. This is called a sample No. 4. In addition, a sample, which has been rolled by use of a roller with projected portion having a width of 4 mm and an amount of projection of 6 mm before it is spliced, is called a sample No. 5.

Then, these five test samples No. 1 to No. 5 have been put to a pass roller pass test, with a tension of 75 kg being loaded onto them. That is, they are respectively passed round a circulating path consisting of 2 rubber rollers (ϕ600), 22 rubber rollers (ϕ200) and 2 rubber rollers (ϕ180) and the number of rounds or laps before they are cut off are examined, respectively. The test results are shown in Table 1.

TABLE 1

| SAMPLE No. | SAMPLE CONDITIONS | NUMBER OF ROUNDS |
|---|---|---|
| Sample No. 1 | roller by a projection roller (having an amount of projection of 0.3 mm) | 202 or more |
| Sample No. 2 | rolled by a projection roller (having an amount of projection of 6 mm) | 10 |
| Sample No. 3 | rolled by a flat roller | 7 |
| Sample No. 4 | rolled by a projection roller (having an amount of projection of 6 mm) before it is spliced, and thereafter it is further rolled. | 24 |
| Sample No. 5 | rolled by a projection roller (having an amount of projection of 6 mm) before it is spliced, and thereafter it is further rolled. | 2 (the shape of the spliced portion is poor due to previous rolling) |

The sample No. 1 and No. 4 are samples which have been rolled by use of a reduction roller according to the invention, while the samples No. 2, No. 3 and No. 5 are samples which have been rolled by use of a conventional reduction roller.

From Table 1, it is found that the numbers of rounds before they are cut off of the samples No. 1 and No. 4 are respectively improved much better when compared with the samples No. 2, No. 3 and No. 5 that have been spliced according to the conventional splicing method and apparatus. That is, this shows that the present invention has a great effect on the improvement of the splicing strength of the metal webs.

As has been described hereinbefore, in accordance with the metal web splicing method and apparatus according to the invention, the spliced portion is rolled while pushing and holding other portions than the portion to be rolled, so that the constrictions and/or wrinkles can be reduced and thus a high quality and local rolling operation can be realized. If this is combined with a butt splicing operation, then the splicing strength can be enhanced to a great extent.

Figure 4:
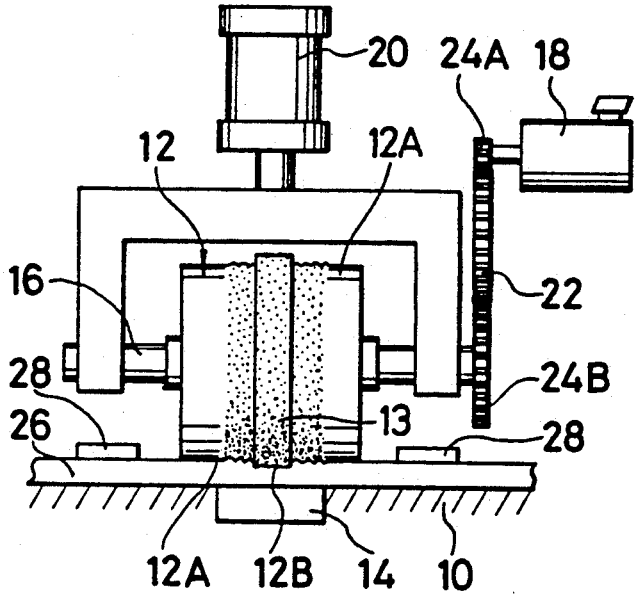
FIG. 4 is a side view of another embodiment of a metal web splicing apparatus according to the invention.

Now, in FIG. 4 there is shown an explanatory view of another embodiment of a metal web splicing apparatus according to the invention. In this figure, the same or similar parts as in the embodiment shown in FIGS. 1 to 3 are given the same designations and the description thereof is omitted here.

Figure 5:
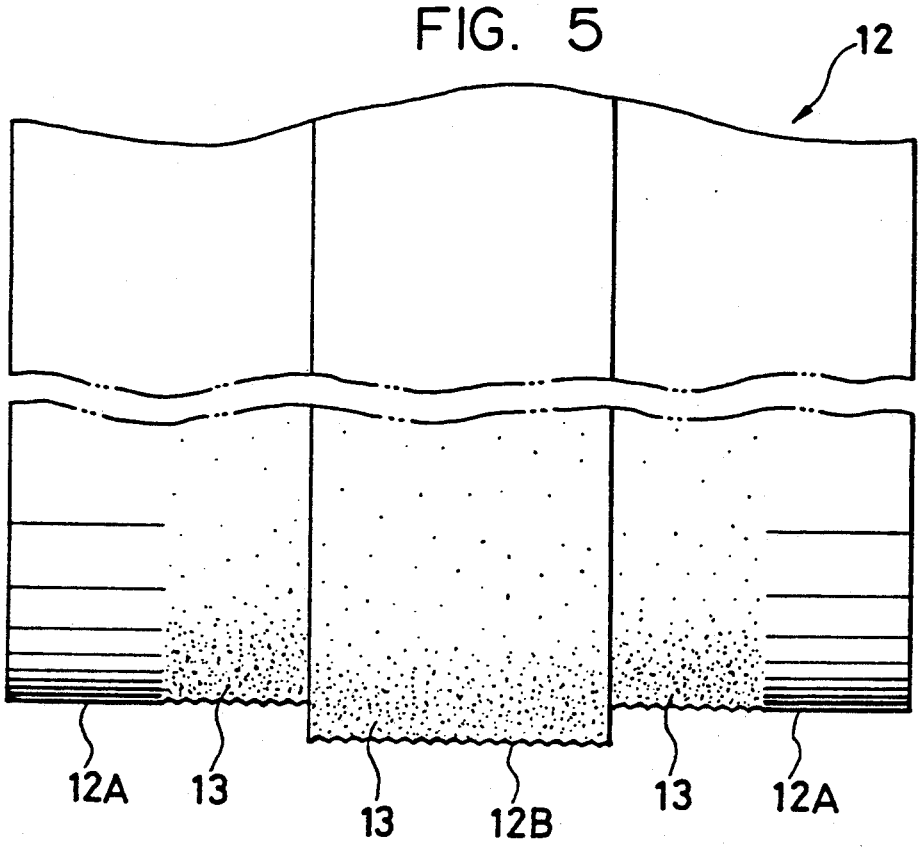
FIG. 5 is an enlarged view of main portions of the outer periphery of a reduction roller according to the invention.

In FIG. 5, there is shown an enlarged view of the outer peripheral portion of a reduction roller.

In the surface of the reduction roller 12, there is formed a roughened surface portion 13 by means of machining such as knurling or grooving, or by means of shot blasting or frame spraying. Due to this, when the spliced portion is rolled, the above-mentioned reduction roller 12 is able to transfer the roughened surface to the surface of the spliced portion.

Next, description will be given of the operation of the metal web splicing apparatus constructed in the above-mentioned manner.

At first, the metal web 26 is held and fixed by a stop jig 28 to the splicing table 10 such that the central part of the rolling portion is placed on the upper surface of the back bar 14. Next, the reduction roller 12 is pushed downward by the cylinder 20, causing the hold portions 12A and 12A to press and fix the metal web 26. Then, if the motor 18 is driven, then the rotational motion of the motor 18 is transmitted through the gear 24A, chain 22 and gear 24B to the reduction roller 12 and the spliced portion is rolled with the central part of the rolling portion held between the projected portion 12B and the back bar 14. By means of this, the central part of the rolling portion is rolled by the projected portion 12B while it is held by the hold portion 12A to thereby be able to reduce in part the thickness of the metal web 26. Due to the fact that the shape of the roughened surface portion 13 of the surface of the reduction roller 12 is transferred to the spliced portion, after rolled, the shortage of surface roughening in the spliced portion in a step of roughening the surface of the metal web can be compensated. Owing to this, the wettability in a coating step can be satisfied.

Figure 6:
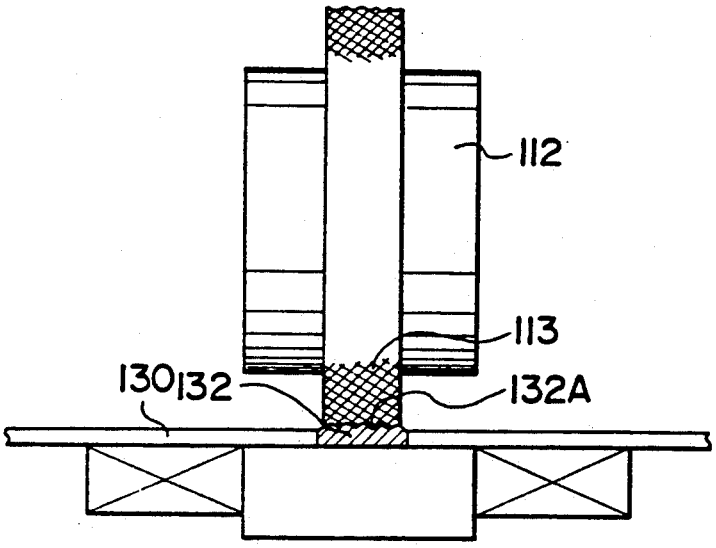
FIG. 6 is a side view of an embodiment of a metal web splicing apparatus according to the invention.

Referring now to FIG. 6, there is shown another embodiment of a splicing method according to the invention, in which, while a knurled roller 112 with projected portion is used to reduce the thickness of the raised section 132A of a spliced portion 132, a surface roughened portion 113 formed in the surface of the roller 112 is transferred to the spliced portion 132. Due to this, similarly as in the above-mentioned embodiment, the wettability of the spliced portion can be satisfied in a step of coating metal webs.

Next, description will be given below of results obtained by comparing the coated state of the spliced portion of metal webs spliced together by a splicing apparatus according to the invention with that according to the prior art.

Figure 7A:
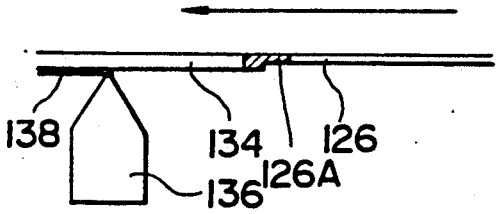
FIGS. 7(*a*) and (*b*) are respectively explanatory views to show how to coat.
Figure 7B:
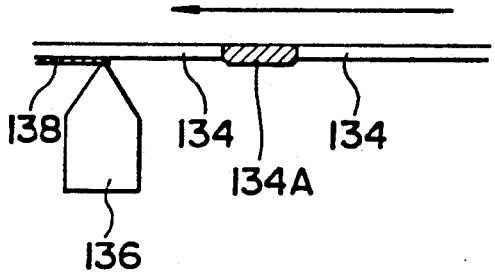
Figure 8A:
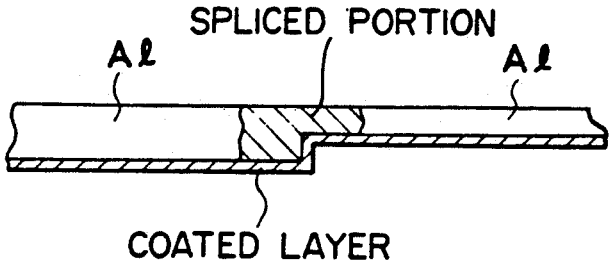
FIGS. 8(*a*) to (*d*) are respectively typical views to show the coated states of a portion spliced by a splicing method according to the invention.
Figure 8B:
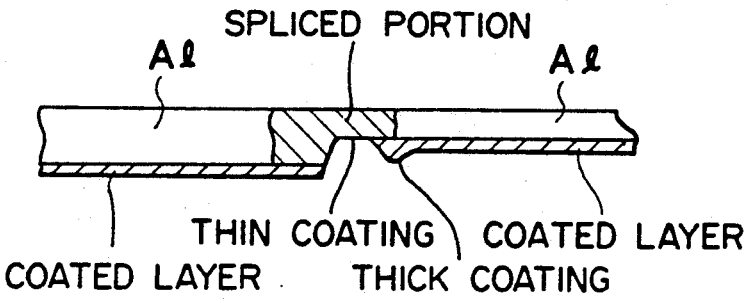
Figure 8C:
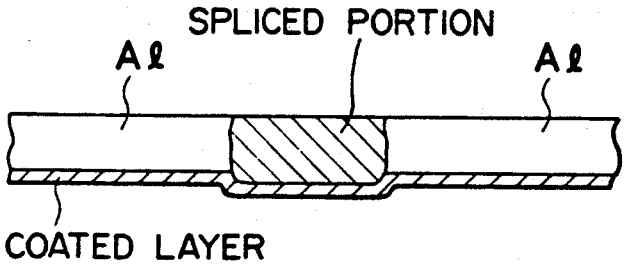
Figure 8D:
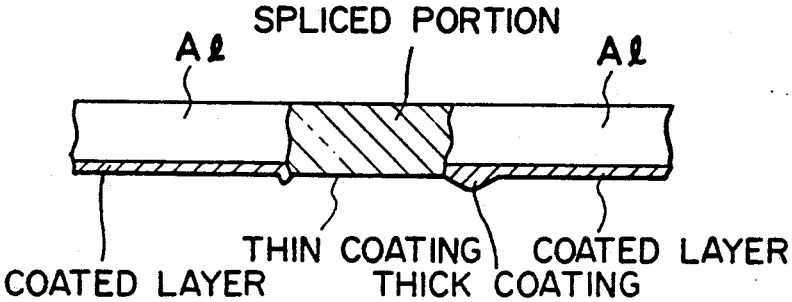

FIGS. 7(*a*) and (*b*) are respectively side views of a coating device applied to the above-mentioned coated state comparison test. In particular, in FIG. 7(*a*), two metal webs 126 and 134, which are different in thickness from each other and are spliced together by welding, are delivered in a direction of an arrow shown in this figure, with the spliced portion thereof facing downwardly, and coating solution are then applied to the lower surfaces of the metal webs 126 and 134 by use of a coating device 136 disposed below the two metal webs. Also, in FIG. 7(*b*), two metal webs 134, 134 having the same thickness are coated in a coating method similar to that in FIG. 7(*a*).

Now, to form test samples No. 11, No. 12 for Table 2, two aluminum plates, one having a thickness of 0.30 mm and a width of 200 mm and the other having a thickness of 0.15 mm and a width of 200 mm, are lapped by 1 mm on each other and then TIG arc welded at the speed of 6m/min, for splicing.

Test samples No. 13 and 14 are produced by lapping two aluminum webs each having a thickness of 0.30 mm and a width of 200 mm by 1 mm on each other and splicing them by welding similarly to the above-mentioned test samples.

The test samples No. 11 and 13 are rolled by a reduction roller which is provided in the outer periphery thereof with a rough surface having a pitch of 0.20 mm and a depth of 0.30 mm. The test samples No. 12 and No. 14 are rolled by a conventional roller having a polished surface.

All of these test samples No. 11 to No. 14 are surface roughened in the same manner. After then, the samples No. 11 and No. 12 are put to test in which a photosensitive layer is coated in a method shown in FIG. 7(*a*), while the samples No. 13 and No. 14 are put to a test in which a photosensitive layer is coated in a method shown in FIG. 7(*b*). In Table 2, there are shown the results of the layer coating test in such a manner that x is used to represent a case when a thick coating occurs and O a case when no thick coating occurs. Now, in FIGS. 8(*a*) to (*d*), there are shown typical views which respectively illustrate the characteristics of the coated states of the above-mentioned test samples No. 1 to No. 4. Referring back again to FIG. 7, numeral 136 designates a coating device and 138 a coated solution.

TABLE 2

| SAMPLE No. | COMBINED THICKNESSES | EVALUATION RESULTS |
|---|---|---|
| 11 (our invention) | 0.30–0.15 | o (excellent) |
| 12 (prior art) | 0.30–0.15 | x (bad) |
| 13 (our invention) | 0.30–0.30 | o (excellent) |
| 14 (prior art) | 0.30–0.30 | x (bad) |

As can be understood from Table 2 and FIGS. 8(*a*) to (*d*), in the samples No. 11 and No. 13 rolled by the reduction roller having a roughened surface portion (see FIGS. 8(*a*) and (*c*)), it is found that the thick coating is hard to occur after the spliced portion is passed, when compared with the test samples No. 12 and No. 14 which are rolled in the conventional rolling method (see FIGS. 8(*b*) and (*d*)). Also, in the test samples No. 11 and No. 13, it is found that the coated solutions do not attach to a pass roller or the like. In the test samples No. 12 and No. 14, it is found that the thick coating thereon cannot be dried sufficiently in a drying step after they are coated but attaches to the pass roller or the like.

As has been described heretofore, according to a splicing apparatus of the invention, by forming a roughened surface portion in the surface of a reduction roller, the spliced portion can be roughened sufficiently when rolling and also the wettability of the spliced portion in a coating step can be kept well, so that the coating aptitude of the spliced portion can be improved. This means that the quality of the spliced metal webs can be improved well.

Figure 9:
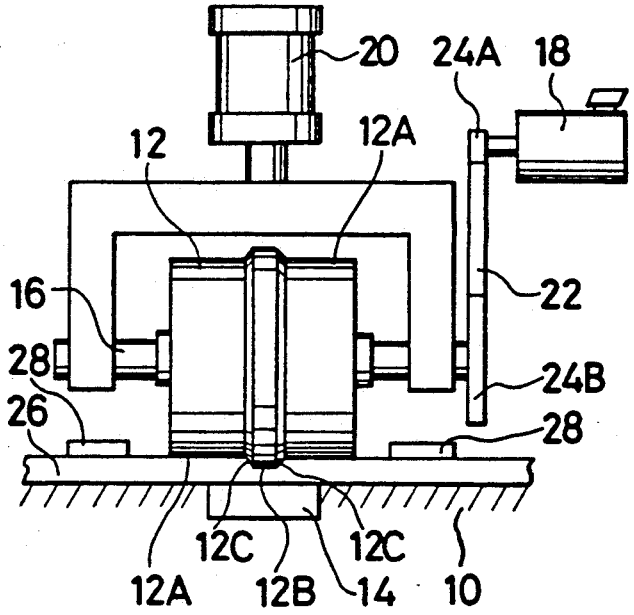
FIG. 9 is a side view of an embodiment of a metal web splicing apparatus according to the invention.

Further, in FIG. 9, there is shown an explanatory view of another embodiment of a metal web splicing apparatus according to the invention. In this figure, the same or similar parts thereof as in the above-mentioned embodiment shown is FIGS. 1 to 3 are given the same designations and the description thereof is omitted here.

Figure 10:
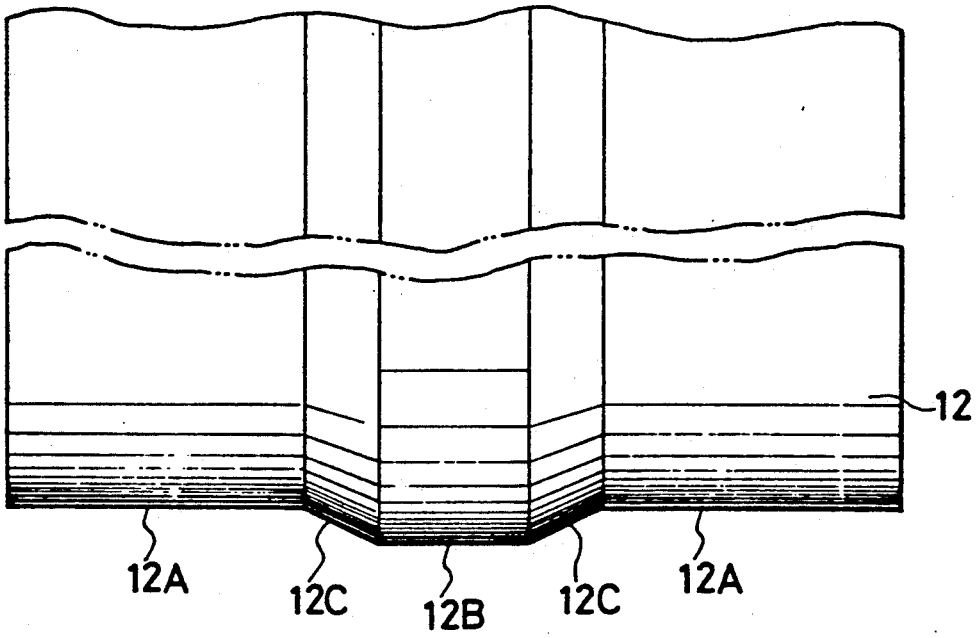
FIG. 10 is a side view of main portions of a roller according to the invention.

A reduction roller 12 comprises hold portions 12A each having a first radius and a projected portion 12B a second radius. Also, in transition portions between the projected portion 12B and the hold portions 12A as shown in FIG. 10, there are formed tapered or curved surfaces 12C and 12C to provide a continuous transition from one level to the other. Further, a difference between the first and second radius, that is, an amount of projection of the projected portion 12B may be 0.1~5.0 or preferably 0.5~2.0 times the thickness difference of the members having been spliced and to be rolled. And, the length of the tapered portion may be 0.15 mm~2.0 mm or preferably 0.5 mm~1.5 mm.

Next, description will be given below of the operation of the metal web splicing apparatus constructed in the above-mentioned manner.

At first, the metal web 26 is held and fixed by the stop jig 28 to the splicing table 10 in such a manner that the central part of the portion to be rolled is placed on the back bar 14. Next, the reduction roller 12 is pushed downward by the cylinder 20 so that the metal web 26 is pressed and fixed by the hold portions 12A, 12A. Then, if the motor 18 is driven, then the rotational motion of the motor 18 is transmitted through the gear 24A, chain 22 and gear 24B to the reduction roller 12 and the metal web 26 is rolled with the central part of the rolling portion being held between the projected portion 12B and the back bar 14, so that the thickness of the metal web 26 can be reduced in part. The central part of the rolling portion is rolled by the projected portion 12B while it is held by the hold portions 12A. Since the shape of the tapered or curved surface is transferred to the edge of the spliced portion after it is rolled, the spliced portion can be rolled smoothly.

Figure 11:
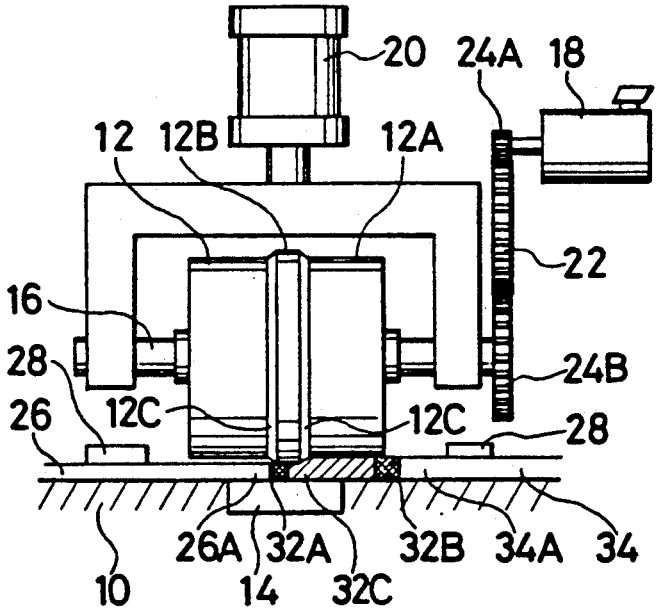
FIG. 11 is a side view of another embodiment of a metal web splicing apparatus according to the invention.
Figure 12A:
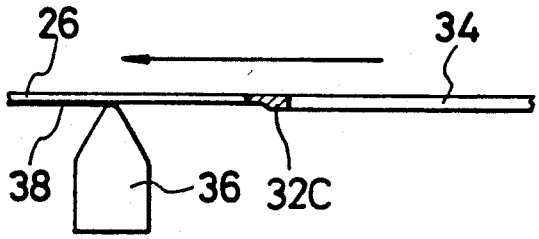
FIGS. 12(*a*) to (*d*) are respectively typical views to show coated conditions obtained in a coating test; and, FIGS. 13, 14 and 15 are respectively side views to show a conventional splicing apparatus.
Figure 12B:
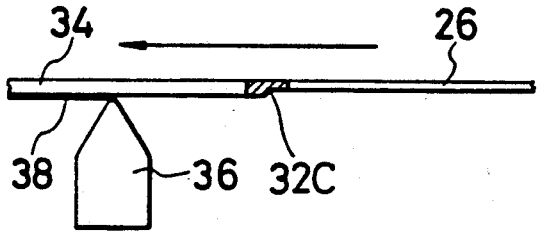
Figure 12C:
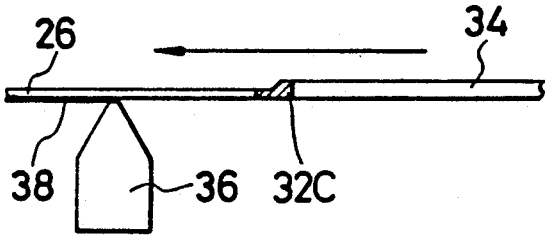
Figure 12D:
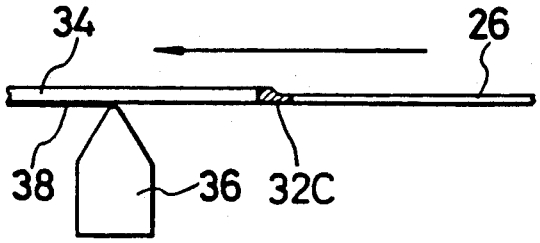
Figure 13:
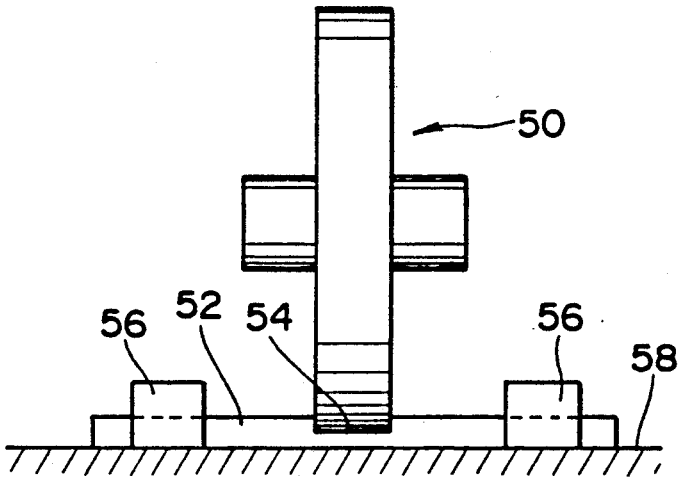
Figure 14:
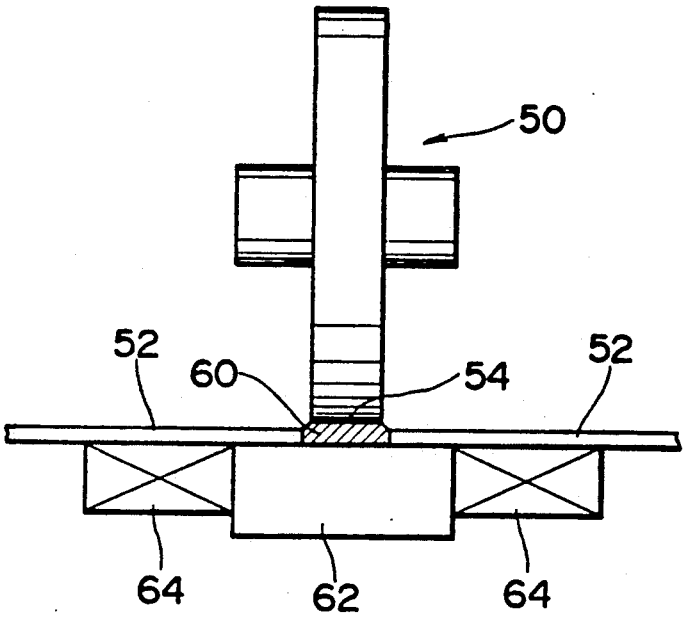
Figure 15:
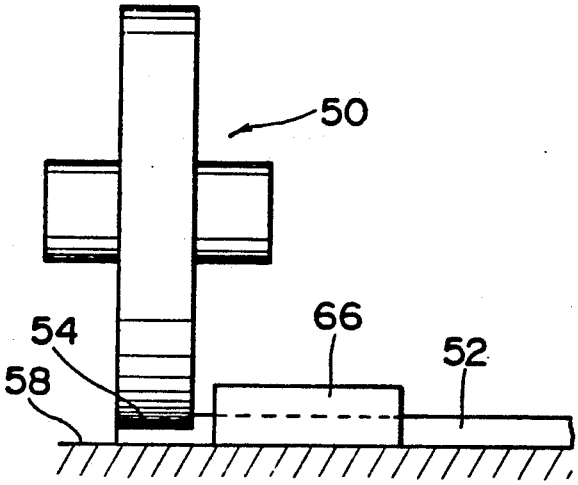

Referring now to FIG. 11, there is shown a state in which two metal webs 26 and 34 differ in thickness from each other are spliced by welding, and, among two recrystallized portions 32A, 32B, one recrystallized portion 32A and a metal web 26A and a fused portion 32C, respectively, adjoining the recrystallized portion 32A are rolled by use of the splicing apparatus which has been described in connection with FIG. 9.

At first, the weldedly spliced metal web 26 is fixed onto the splicing table 10 by the stop jig 28. Next, the roller 12 is pushed downward by the cylinder 20 and the central part of the rolling portion is held between and fixed by the projected portion of the roller and the back bar 14. After then, the portion of the metal web 26 adjacent to the central part of the rolling portion is pressed against the splicing table 10 and back bar 14 by the hold portion 12, and the recrystallized portion 32A, fused portion 32C and the leading end portion 26A of the metal web 26 are rolled simultaneously by the projected portion 12B. That is, by means of such rolling, the thicknesses of not only the recrystallized portion 32A but also the fused portion 32C and the metal web leading end portion 26A can be made to be substantially equal to one another (more exactly, the difference among the thicknesses of these three portions is within 30%). Also, the tapered or curved surface 12C allows the spliced portion to be rolled in such a manner that the thickness of the fused portion 32C can be tapered. In this manner, according to the metal web splicing apparatus of the invention, due to the fact that the thickness varying section of the spliced portion is formed smoothly, that is, tapered or curved, it is possible to provide a spliced portion which is hard to break and at the same time the quality of the spliced metal web can be maintained when the coating solutions are applied. Also, since, in the butt or lap welded, spliced portion, the differences among the thicknesses of the fused portion are formed tapered to thereby reduce the web thickness difference in the neighboring portions of the recrystallized portion having a low repetitive bending strength, the centralization of stresses on the recrystallized portion can be reduced and at the same time is possible to prevent the lowering of the quality of the spliced metal web when it is coated with coating solutions.

It should be noted here that the recrystallized portion 32B on the side of the metal web 34 and the end portion 34A of the metal web 34 and also rolled by means of the hold portion 12A similarly to the above-mentioned recrystallized portion 32A, fused portion 32C and end portion 26A.

Next, description will be given below of the results obtained when the coated state of the spliced portion of the metal webs spliced by the splicing apparatus of the invention is compared with that by a conventional splicing apparatus with reference to Table 3.

For samples in this comparison test, two aluminum webs, one of which has a thickness of 0.30 mm and a width of 200 mm and the other has a thickness of 0.15 mm and a width of 200 mm, are lapped by 1 mm on each other and are then TIG arc welded together at the speed of 6m/min, for splicing. After the two aluminum webs are spliced in this manner, the spliced portion thereof is rolled by a reduction roller having a width of 4 mm and amount of projection of 0.15 mm in such a manner that thickness differences in the neighboring portions of a recrystallized area occurring on the side of the aluminum web having a thickness of 0.15 mm can be minimized. The resultant products are referred here to as samples Nos. 21, 22, 23 and 24, respectively. In particular, to form these test samples Nos. 21, 22, 23 and 24, the weldedly spliced portion is rolled by different rollers, that is, a roller having a projected portion including a tapered portion of 0.15 mm in width, a roller having a projected portion including a tapered portion of 1.0 mm in width, a roller having a projected portion including a tapered portion of 2.0 mm in width, and a roller having a projected portion including no tapered portion, respectively. For all of the four kinds of samples, four kinds of coating tests were conducted. The four tests, that is, Tests A, B, C and D are typically illustrated in FIGS. 12(*a*) to (*d*), respectively. In the drawings, numeral 36 designates a coating device and 38 a coated layer.

The results that are obtained from the examination as to the coated states after the respective tests are shown in Table 3. Evaluation items in Table 3 includes whether swallow-in of air bubbles is present or not, the length of a coating line or stripe occurring when the air bubbles are swallowed in, whether a thick coating is present or not in the neighboring portion of the spliced portion when the air bubbles are swallowed in, and the length of range of the thick coating occurred.

TABLE 3

| | test | | | |
|---|---|---|---|---|
| sample | A | B | C | D |
| No. 21 Taper Width 0.15 mm | no air bubbles are swallowed in thick coating of 40 mm | no air bubbles are swallowed in thick coating of 30 mm | no air bubbles are swallowed in | |
| No. 22 Taper Width 1 mm | no air bubbles are swallowed in no thick coating | no air bubbles are swallowed in no thick coating | | |
| No. 23 Taper Width 2 mm | no air bubbles are swallowed in no thick coating | no air bubbles are swallowed in coating no thick coating | no thick | |
| No. 24 No Taper | air bubbles are swallowed in by 500 mm thick coating of 40 mm | air bubbles are swallowed in by 2000 mm thick coating of 50 mm | | |

As can be clearly understood from the results shown in Table 3, the samples No. 21, No. 22 and No. 23 that have been rolled by the reduction roller formed with a tapered surface are found better in coating aptitude than the sample No. 24 rolled by the reduction roller with no tapered surface in the tests A and B, especially in the test B.

Next, another pass roller test is conducted on the above-mentioned samples No. 21, No. 22, No. 23 and No. 24, with a tension of 75 kg being loaded thereto. In particular, they are passed respectively round a circulating path consisting of 2 rubber rollers (ϕ600), 22 rubber rollers (ϕ200) and 2 rubber rollers (ϕ180) and the numbers of rounds or laps until they are cut off and examined, respectively. The results obtained from this pass roller test are shown in Table 4.

TABLE 4

| SAMPLE No. | Number of Rounds before Occurrence of Cutting and/or Cracking |
|---|---|
| No. 21 | 200 rounds |
| Taper Width 0.15 mm | no cutting and/or cracking occurred |
| No. 22 | 200 rounds |
| Taper Width 1 mm | no cutting and/or cracking occurred |
| No. 23 | 187 rounds |
| Taper Width 2 mm | cracking occurred |
| No. 24 | 200 rounds |
| no Taper | no cutting and/or cracking occurred |

As can be clearly understood from the results shown in Table 4, it is found that the samples No. 21 and No. 22 are equal in strength to the conventional sample No. 24. On the other hand, it is true that the sample No. 23 is slightly inferior in a pass roller passability to the conventional sample No. 24, but its passability is within a range which provides no problem practically. In case when the level different portion is shaped in a curved surface, similar effects can be provided.

As has been described heretofore, in accordance with the metal web splicing apparatus according to the invention, due to the fact the level different portion existing between the projected portion of the roller and the hold portion thereof is shaped in a tapered or curved surface to thereby prevent the shape of the level different portion being transferred to the spliced portion, there is eliminated the influences due to the swallowing-in of the air bubbles or the like so that the coated state can be improved, resulting in the enhancement of the quality of the spliced metal web.

It should be understood, however, that there is no intention to limit the invention to the specific forms disclosed, but on the contrary, the invention is to cover all modifications, alternate constructions and equivalents falling within the spirit and scope of the inventions as expressed in the appended claims.

What is claimed is:

1. A method of splicing together thin planar metal webs, in which metal webs are butted against each other or slightly lapped on each other and spliced together by welding, and, by use of a reduction roller comprising a hold portion having a first radius and a projected portion having a second radius slightly greater than said first radius, the spliced portion of said metal webs is rolled by said projected portion of said roller while both sides of said spliced portion of said metal webs are being held and fixed by said hold portion of said roller.

2. A method as set forth in claim 1, wherein while said metal webs are being held and fixed by said hold portion of said reduction roller, at least one of two recrystallized portions occurring in said weldedly spliced portion and the two neighboring portions of said recrystallized portion are rolled by said projected portion of said roller in such a manner that thickness differences between said respective recrystallized portions and said neighboring portions are within 30%.

3. A method of splicing rolling the end portion of a thin, planar metal web in preparation for a splicing thereof, said method comprising:

providing a reduction roller comprising a hold portion having a first radius and a projected portion having a second radius slightly greater than said first radius, and rolling the end portion of said metal web by said projected portion of said roller while simultaneously holding and fixing a portion adjacent of said end portion of said metal web by said hold portion of said roller.

4. An apparatus for splicing together metal webs, wherein there is included a reduction roller comprising a hold portion having a first radius and a projected portion having a second radius slightly greater than said first radius and wherein both sides of the spliced portion of said metal webs are held and fixed by said hold portion of said reduction roller and said spliced portion is rolled by said projected portion of said roller.

5. An apparatus as set forth in claim 4, wherein an amount of projection of said projected portion of said reduction roller with respect to said hold portion is 0.1~5 times the thickness of members having been spliced and to be rolled.

6. An apparatus as set forth in claim 4, wherein an amount of projection of said projected portion of said reduction roller with respect to said hold portion is 0.5~2 times the thickness of member having been spliced and to be rolled.

7. An apparatus as set forth in claim 5, wherein an amount of transition between said projection portion and said hold portion of said reduction roller is 0.1~5 times the thickness difference between members to be spliced.

8. An apparatus as set forth in claim 6, wherein an amount of transition between said projection portion and said hold portion of said reduction roller is 0.1~5 times the thickness difference between members to be spliced.

9. An apparatus as set forth in claim 7, wherein said amount of said transition is 0.5~2 times the thickness difference between members to be spliced.

10. An apparatus as set forth in claim 8 wherein said amount of said transition is 0.5~2 times the thickness difference between members to be spliced.

11. An apparatus for splicing together metal webs, comprising:

a reduction roller comprising a hold portion having a first radius and projected portion having a second radius slightly greater than said first radius, and wherein both sides of the spliced portion of said metal webs are held and fixed by said hold portion of said reduction roller and said spliced portion is rolled by said projected portion of said roller, and a roughened surface portion on both said hold and projected portions of said reduction roller.

12. An apparatus for splicing together metal webs, comprising:

a reduction roller comprising a hold portion having a first radius and projected portion having a second radius slightly greater than said first radius, and wherein both sides of the spliced portion of said metal webs are held and fixed by said hold portion of said reduction roller and said spliced portion is rolled by said projected portion of said roller, and a transition portion interposed between said hold and projected portions of said reduction roller, said transition portion comprising a tapered or curved surface.

* * * * *